United States Patent [19]

Allen et al.

[11] 4,078,608

[45] Mar. 14, 1978

[54] THERMAL OIL RECOVERY METHOD

[75] Inventors: Joseph C. Allen, Bellaire; Harley L. Tanner, Houston, both of Tex.

[73] Assignee: Texaco Inc., New York, N.Y.

[21] Appl. No.: 780,219

[22] Filed: Mar. 23, 1977

Related U.S. Application Data

[63] Continuation-in-part of Ser. No. 635,562, Nov. 26, 1975, abandoned.

[51] Int. Cl.[2] ..... E21B 43/24

[52] U.S. Cl. ..... 166/266; 166/272

[58] Field of Search ..... 166/272, 303, 258, 266, 166/268, 267, 265

[56] References Cited

U.S. PATENT DOCUMENTS

| | | | |
|---|---|---|---|
| 2,584,605 | 2/1952 | Merriam et al. | 166/272 X |
| 2,670,802 | 3/1954 | Ackley | 166/272 |
| 2,862,558 | 12/1958 | Dixon | 166/272 |
| 2,897,894 | 8/1959 | Draper et al. | 166/272 |
| 3,233,670 | 2/1966 | Thompson et al. | 166/272 X |
| 3,294,167 | 12/1966 | Vogel | 166/272 |
| 3,302,713 | 2/1967 | Ahearn et al. | 166/272 X |
| 3,675,715 | 7/1972 | Speller, Jr. | 166/272 X |
| 3,679,264 | 7/1972 | VanHulsen | 166/303 |
| 3,692,111 | 9/1972 | Breithaupt et al. | 166/272 X |

*Primary Examiner*—Stephen J. Novosad
*Attorney, Agent, or Firm*—Carl G. Ries; Thomas H. Whaley; Jack H. Park

[57] ABSTRACT

Viscous oil may be recovered from subterranean, viscous oil-containing formations by injecting a heated aqueous fluid into the formation to raise the temperature of the viscous petroleum, and to displace it toward a remotely located production well. The heated aqueous fluid, which may be liquid, gaseous or a mixture thereof, is obtained from a deeper, higher temperature permeable oil formation. At least two spaced apart fluid flow communication means are established between the surface of the earth and the deeper, high temperature formation. At least two spaced apart separate communication means are established between the surface of the earth and the shallow viscous oil formation. Ordinarily the deeper, high temperature oil formation is one in which secondary recovery, e.g., waterflooding, will be ended or approaching the point where further production of oil and water is not commercially justified. At the conclusion of waterflooding, however, a typical oil formation will still have from 30–70% of the oil originally in place left in the formation. Any suitable heat transfer fluid, usually field water, is injected into the deep, high temperature formation where it passes through the permeable formation and in consequence of contacting the higher temperature mineral matrix of the formation, its temperature is elevated prior to exiting from the formation via the second communication means. Hydrocarbons are also recovered with the water, including some dissolved in the water at the high temperature and pressure of the deep formation.

3 Claims, 1 Drawing Figure

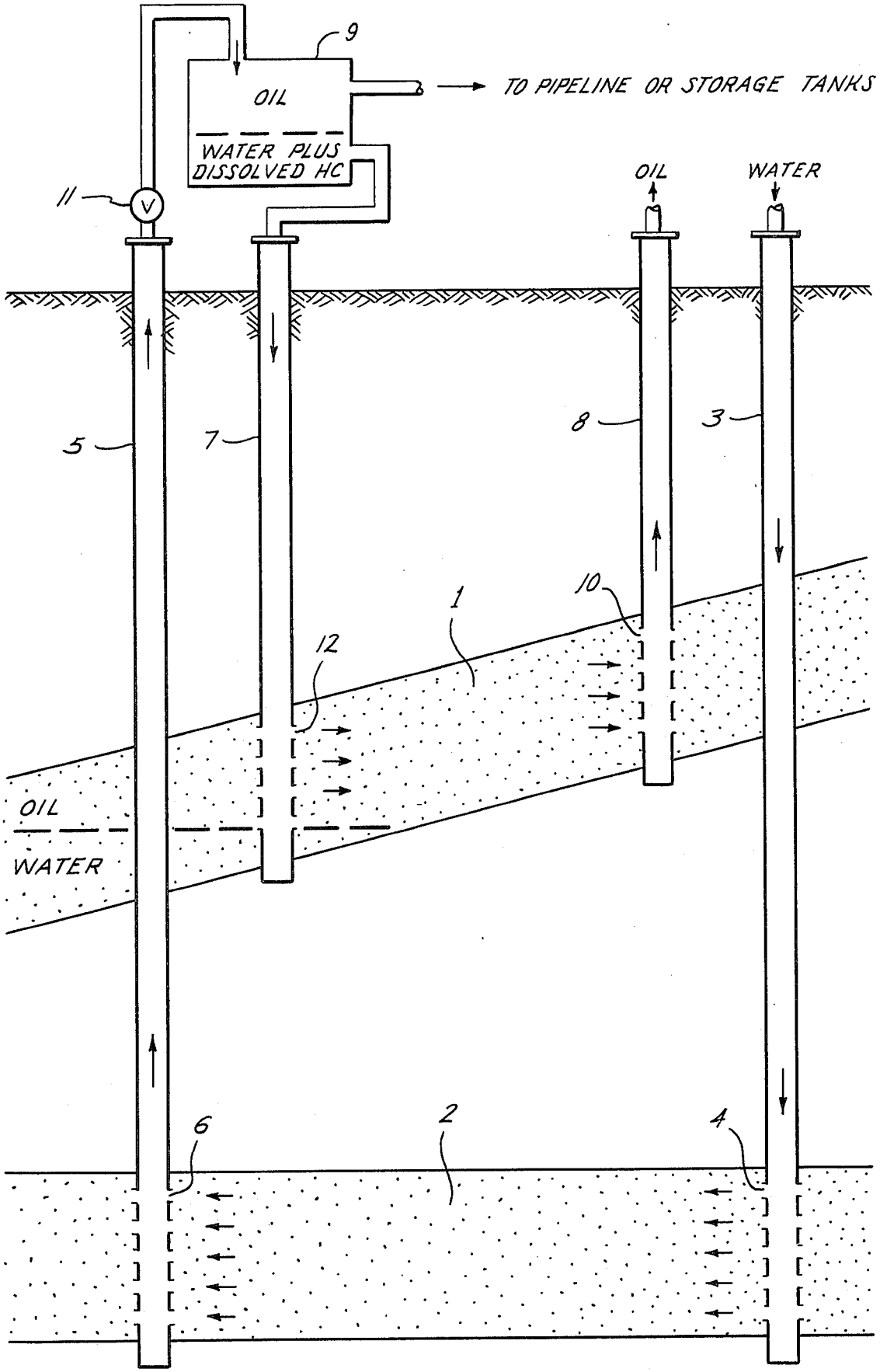
9
OIL
WATER PLUS DISSOLVED HC
TO PIPELINE OR STORAGE TANKS
11
V
OIL
WATER
5
7
8
3
10
1
12
OIL
WATER
6
2
4

THERMAL OIL RECOVERY METHOD

CROSS-REFERENCE TO RELATED APPLICATION

This is a continuation-in-part of copending application Ser. No 635,562 filed Nov. 26, 1975 for "Thermal Oil Recovery Method," now abandoned.

BACKGROUND OF THE INVENTION

1. Field of the Invention

This invention pertains to an oil recovery method, and more particularly to a thermal oil recovery method in which a second permeable oil formation having a temperature higher than the temperature of the first viscous oil-containing formation is utilized to heat water and dissolve hydrocarbons from the deep formation which mixture of water and hydrocarbons is then injected into the viscous oil formation to displace and decrease the viscosity of the viscous oil contained in the viscous oil formation.

2. Description of the Prior Art

There are many subterranean, viscous petroleum-containing formations for which little or no petroleum can be recovered even though the formation permeability is adequate for ordinary oil recovery operations, because the petroleum at formation conditions is so viscous that substantially no movement of petroleum occurs even if a pressure differential is applied across the formation. That is to say, even in primary recovery operations in which natural energy existing in the formation is utilized for oil recovery, such as bottom water drive or solution gas drive, etc. or by application of enhanced recovery methods in which an artificial energy drive is applied to the formation, such as by water flooding, only a small fraction or even none of the oil present in the formation can be recovered. In order to permit recovery of viscous petroleums from such formations, some treatment must be employed to decrease the viscosity of the petroleum to a value at which it will move through the permeable formation.

For the purpose of the present application, we mean by the term "visous petroleum," any formation petroleum having an API gravity less than about 25° API, which corresponds to a viscosity at standard conditions of about 30 centipoise at 100° F.

Thermal recovery methods have been utilized in the past and there are many discussions thereof in the literature. Steam flooding has been especially successful in recovering viscous petroleum from many viscous petroleum-containing formations. Hot water flooding has also been used successfully for such purposes.

In the past, a commercially successful recovery operation required that there be available in the vicinity of the field from which petroleum is being recovered, an inexpensive source of fuel such as natural gas or other hydrocarbon fuels. Because of the recently developed shortage of natural gas and other hydrocarbon fuels, it has become increasingly difficult to locate a source of fuel to heat the water or other fluid for thermal recovery operations.

In view of the foregoing discussion and the present critical energy shortage, it can be appreciated that there is a substantial need for a method of recovering viscous petroleum from subterranean, viscous petroleum-containing formations which do not require the burning of extraneous fuels on the surface of the earth for the purpose of generating the steam or other heated fluid to be injected into the oil formation.

SUMMARY OF THE INVENTION

Briefly, the process of our invention involves locating a permeable oil formation, which will ordinarily be at a greater depth than the viscous oil formation from which viscous oil is to be recovered using our process, having a temperature substantially higher than the viscous oil formation. The deeper, high temperature oil formation may be one which has already been depleted, although such formations still contain substantial residual oil after commercial oil production is ended. For the purpose of this process, we require that the temperature of the lower, permeable oil formation be at least 100° F and preferably at least 200° F greater than the temperature of the oil formation. At least two wells are drilled from the surface of the earth into the lower, permeable, high temperature oil formation and both wells are perforated to establish fluid communication between the wells and the permeable formation. At least two wells will be drilled into the viscous oil formation separate from the two wells discussed above, one completed as a production well and one as an injection well. Water is injected into and passed through the lower, hot formation, brought to the surface and, if any appreciable oil is mixed therewith, separated into separate oil and water phases. The separator is maintained at a pressure well above atmospheric pressure, preferably about equal to the pressure in the deep, hot depleted oil formation. Likewise, heat losses are minimized by insulation on the water production well, surface flow lines, oil-water separator, and hot fluid injection well. Preferably, additional heat is supplied to the separator to maintain the fluid temperature near the temperature of the deep, hot, depleted oil formation. Water passing through the deep, hot, depleted oil formation dissolves both gaseous and liquid hydrocarbons from the residual oil in the deep, hot, depleted oil formation. Since the miscibility of hydrocarbons in water increases with both temperature and pressure, up to about 600° F and 600 pounds per square inch, at which complete miscibility is attained, more hydrocarbons can be dissolved at the higher temperature and pressure of the deep, hot depleted oil formation than is possible at the pressure and temperature existing on the surface or in the shallow, lower temperature viscous oil formation. If the produced fluid were separated at ambient or reduced pressure and temperature as in conventional practice, substantially less hydrocarbons would remain dissolved in the water than occurs when following the procedures of our invention. Presence of hydrocarbons in the hot water or steam injected into the oil formation aids in oil recovery in several ways. Injection of water containing hydrocarbons in excess of the equilibrium solubility level causes partitioning of hydrocarbons from the injected water into the viscous oil, which reduces the viscosity of the viscous oil and facilitates recovery. Gaseous hydrocarbons may be released from the hot water, resulting in pressure increases in the pore spaces of the formation. Moreover, when water containing gas dissolved therein is injected into an oil formation, gas partitioning from the viscous oil into water which would result in an increase in the oil viscosity, is prevented. The heated aqueous fluid injected into the viscous oil formation also acts as a drive fluid to displace petroleum toward the production well, where it is recovered to the surface of the earth.

BRIEF DESCRIPTION OF THE DRAWING

The attached drawing illustrates in cross-sectional view, two subterranean formations, one shallow viscous oil-containing formation, and a deeper, high temperature permeable formation through which the water is passed prior to flowing to the surface, through a high temperature, high pressure separator, and then hot water with dissolved hydrocarbons is injected into the viscous oil formation.

DESCRIPTION OF THE PREFERRED EMBODIMENTS

Briefly, the process of our invention involves a thermal viscous oil recovery method in which the injected drive fluid is first heated by passing it through a subterranean permeable oil formation whose temperature is substantially greater than the temperature of the viscous oil formation, so the benefits of thermal recovery may be realized for the purposes of recovering heavy oil or viscous oil from a formation without necessitating the use of any extraneous fuel such as field gas or natural gas. In addition, by maintaining the heated water at about the same temperature and pressure as the deeper oil formation, hydrocarbons remain dissolved in the hot water which aids in recovering the viscous petroleum.

The process of our invention may best be understood by reference to the attached drawing, in which viscous oil formation 1 lies some distance above permeable oil formation 2, the temperature of formation 2 being substantially greater than the temperature of formation 1. For the purpose of the present invention, it is sufficient if the temperature of formation 2 is at least 100° F and is preferably at least 200° F greater than the temperature of formation 1. The minimum temperature differential which will permit application of this process depends in part on the petroleum viscosity as well as the viscosity-temperature relationship of the viscous petroleum found in formation 1. It is essential that the higher temperature oil formation 2 have sufficient permeability to permit the passage of water or other aqueous fluid therethrough. The permeability of formationn 2 must be at least 100 millidarcies and is preferably at least 500 millidarcies in order to permit passage of water or other fluid therethrough at a sufficiently high flow rate to effect the desired viscosity reduction of the petroleum in formation 1. Ordinarily, the higher temperature oil formation 2 will be located at a substantial distance below formation 1 since the usual temperature gradient experienced, in earth formations is one of increasing temperature with depth below the surface of the earth. The deeper oil formation will ordinarily be one in which primary oil recovery has already been completed and probably secondary recovery operations, e.g., waterflooding, will have proceeded at least to the point that a high water cut is being obtained. At the water oil ratio at which waterflooding is ordinarily terminated for economic reasons, from 30–70% of the oil originally present in the formation will still be contained therein.

In order to permit the passage of water into formation 2, a well 3 is drilled from the surface of the earth to formation 2, and perforation or other combination means 4 are established in at least a portion of the well penetrating formation 2, and preferably throughout the entire vertical thickness of formation 2. This permits the injection of field water into the formation, in order to ensure an adequate flow rate of water into the oil formation 2. Well 5 is similarly drilled from the surface of the earth to a point at or below the bottom of high temperature oil formation 2, and fluid communication means such as perforations 6 are established in at least a portion of well 5 adjacent formation 2, so fluids may flow freely from formation 2, into well 5. Injection well 7 and production well 8 are drilled and completed in the shallower, viscous oil containing formation 1. The output of well 5 feeds into an oil-water separator 9 on the surface of the earth. The oil recovered from separator 9 is sent to pipe lines or storage tanks. Separator 9 is operated at a pressure and temperature substantially greater than surface ambient pressure and temperature. By maintaining the temperature and pressure in the separator 9 at a value above surface ambient conditions and preferably at a value which is at least 80% of the temperature and pressure of deeper formation 2, the equilibrium condition of hydrocarbons dissolved in water that exists at the time water leaves formation 2 and enters well 5 via perforations 6 is maintained. The solubility of hydrocarbons, especially low molecular weight fractions of residual petroleum in oil formation 2, are much higher at the elevated temperature and pressure of formation 2 than at surface ambient conditions, since the temperature and pressure of formation 2 is substantially above surface ambient levels. The solubility of oil in water increases with temperature and pressure up to about 600° F and 600 pounds per square inch, at which conditions water and oil are completely miscible. While conditions where complete miscibility are attained are unlikely to exist in the formation, the solubility of oil in water is higher than at surface conditions.

Ordinarily, the flow rate of hot fluid from formation 2 to formation 1 should be at the highest possible rate, so no flow rate control device in well 5 is needed except in unusual circumstances. A cutoff device 11 is preferably inserted between the deep formation 2 and the surface separator 9 for safety purposes. If desired, device 11 may be a flow rate throttling mechanism.

Well 7 is drilled from the surface of the earth to a point at or below the bottom of the oil formation 1, and perforations 12 are established in at least a portion thereof and preferably throughout the entire vertical thickness of formation 1, so fluids may flow freely from well 7 into formation 1. Production well 8 is similarly perforated to permit flow of fluids from formation 1 into well 7 and then flow or be pumped to the surface of the earth.

Wells 5 and 7 can be combined to a single multiconductor well, although they are shown as separate wells for the purpose of illustration in the attached figure. It would be possible for example, to drill a single well from the surface of the earth to point below the bottom of formation 2 with one string of tubing extending to a point below formation 2 with fluid communication established between said tubing string and formation 2 and either the annular space or a second tubing string complete in formation 1 for water injection.

In the practice of the process of our invention in the formation into which wells have been drilled and completed according to the general method as is shown in the attached Figure, water is injected into well 3 to pass into deep hot oil formation 2 via perforations 4. The void space of formation 2 may be totally filled with liquid, usually brine, or it may be partially or totally gas filled.

As field water is injected into the formation adjacent injection well 3, formation water ordinarily is the first fluid which flows through perforation 6 of well 5 upward toward the surface. Ordinarily formation 2 will be in the later stages of waterflood, so the field water and formation water will be similar or identical.

It should be pointed out that certain subterranean high temperature formations are sufficiently active aquifiers that water may be supplied to the oil formation at the desired rate without the need of injecting surface water into the high temperature formation. In the event formation 2 is an active aquifer with sufficient capability for supplying water to meet the injection rate requirements, well 3 would not be needed and only wells 5, 7 and 8 would be utilized.

The hot fluid flow shut off device 11 provides a means for shutting off the flow of hot fluids therethrough in the event it becomes necessary to do so.

In another embodiment of the process of our invention, a downhole heater may be located in injection well 7 between the surface and perforations 12 in formation 1, for the purpose of increasing the temperature of the fluid passing therethrough into formation 1 from well 7. This is necessary when the temperature of the water exiting from separator 9 is not sufficiently high to reduce the viscosity of the oil in formation 1 to a level at which the oil is easily displaced through the formation. The present arrangement is still advantageous, since the amount of heat which must be supplied by means of a downhole supplemental heater is much less than would ordinarily be the case, if geothermal heat were not being simultaneously supplied to formation 1.

It is important to realize that this process may be used even when the permeable formation temperature is far below what is normally considered to be a geothermal formation, since in the latter case the steam temperature must be sufficiently high to operate electrical generating equipment. Also, dissolved salts in the produced water are very detrimental in processes using geothermal energy to generate electricity, whereas such water may often be used for oil recovery purposes without serious problems.

FIELD EXAMPLE

For the purpose of additional disclosure, but without intending that it be in any way limitative or restrictive or our invention, the following field example is offered.

An oil field is known to contain at least two permeable oil-containing formations, one of which is located at a depth of 1,000 feet and contains large volumes of 20° API, 160 centipoise petroleum, which is so viscous that only a minor portion thereof can be recovered by conventional primary or secondary recovery. The temperatures of the viscous oil formation is 90° F. At a depth of 3,500 feet there is located a petroleum reservoir having a temperature of about 195° F, which is producing water and oil at a relatively high rate. The temperature of the fluid being produced at the surface of the earth is about 170° F. Production from the deeper formation is by waterflood and is nearing a terminal stage, because the water cut is approximately 98 percent.

Two additional wells are drilled to a depth slightly below the bottom of the 1,000-foot deep formation, and perforations are formed throughout the full thickness of each well. Existing water injection wells and production wells completed in the deep, hot formation are utilized for this process by simple continuing injecting water into the formation and producing oil and water at the high water cut from the deep formation long past the point where water flooding would ordinarily be terminated for economic reasons.

The high water-cut oil water mixture is produced and fed directly into a high pressure, high temperature oil water separator. A pressure booster pump is utilized on the input side of the separator to maintain the pressure in the separator at a value equal to about 1500 pounds per square inch. The separator temperature is maintained at 195° F by a steam jacket. These measures insure that the amount of hydrocarbons dissolved in the water while passing through the deep oil formation remains essentially unchanged.

Since the temperature of the shallow formation is 90° F and the temperature of the deeper formation is 195° F, the $\Delta T$ is 105° F and the $\Delta H$ (enthalpy difference) is 105 BTU/LB of water. The porosity of the shallow formation is 37 percent and the residual oil saturation is 0.52 or 52 percent which corresponds to about 1,500 barrels per acre foot of formation. Water is produced from the deeper formation at a rate of 1,500 barrels per day and is injected into the upper formation at the same rate. The pressure in the shallow formation is about 1,500 psi.

The following heat transfer calculations are made on a basis of one barrel of oil in the upper or shallow formation. The volume of formation rock associated with one barrel of oil is as follows:

$$\text{Rock volume} = \frac{1 \times 5.6}{.37 \times .52} = 29\ \text{ft}^3$$

The volume of water required to heat the 29 cubic feet of formation rock to a temperature of 195° F is as follows:

$$\text{Volume water} = \frac{36 \times 105 \times 29 \times 5.6}{105 \times 350} = 16.7\ \text{ft}^3$$

From the above, it is determined that a total of 1.5 pore volumes of hot water is required to heat the shallow viscous oil formation to a temperature of 195° F, and 2.0 pore volumes must be injected to displace sufficient oil to reduce the residual oil saturation to a value of 24 percent. Thus a total of 3.5 pore volumes of 190° F water is injected into the shallow, viscous oil-containing formation and recovers $$\frac{(.52 - .24) \times 110}{.52} = 53.8$$

percent of the oil.

Thus, we have disclosed that viscous oil may be recovered from subterranean, viscous oil-containing formations by utilization of geothermal energy present in deeper, hot depleted oil formations. Hot fluids are obtained from a subterranean depleted oil formation located below the viscous oil formation separated on the surface at a temperature and pressure about equal to the deeper formations, and passed through the viscous oil formation to heat the viscous oil and displace it toward the production well. The method assures retaining hydrocarbons dissolved from the deep formation in the drive water and obviates the need to utilize hydrocarbon fuels on the surface for the purpose of heating the thermal recovery fluid. While our invention has been described in terms of a number of illustrative embodiments, it is not so limited since many variations thereof will be apparent to persons skilled in the art of oil recovery without departing from the true spirit and scope of our invention. It is our desire and intention that our invention be limited only by those limitations and restrictions as appear in the claims appended hereinafter below.

We claim:

1. A method of recovering viscous petroleum from a first subterranean, viscous petroleum-containing formation, which petroleum formation overlays a second permeable oil formation having a temperature at least 100° F above the temperature of the first formation, comprising:

(a) penetrating both formations with at least one injection well and at least one production well, all wells being in fluid communication with their respective formations;

(b) injecting an aqueous fluid comprising water in the injection well into the second formation and recovering water heated to about the temperature of the second formation therefrom via the production well to the surface;

(c) separating the produced fluid into oil and water in a separator on the surface, the temperature and pressure of the separator being maintained at values which are at least 80% of the temperature and pressure of the second formation; and (d) injecting the hot water from the separator into the first formation via the injection well to displace viscous petroleum toward the production well and thereby to the surface of the earth.

2. A method as recited in claim 1 comprising the additional step of locating a heating device in the second well adjacent the first formation and heating the fluid entering the first formation.

3. A method of recovering viscous petroleum from a subterranean first permeable viscous petroleum-containing formation penetrated by a first injection means and a first production means, below which is located a second permeable depleted oil formation penetrated by a second injection and production means, the temperature of the second formation being at least 100° F greater than the temperature of the first formation, comprising:

(a) introducing an aqueous fluid comprising water via the second injection means into the second formation to heat said fluid said fluid dissolving residual hydrocarbons in the second formation;

(b) producing said hot aqueous fluid and oil from the formation to the surface via the second production means;

(c) separating the produced fluid into an oil phase and a water phase which contains dissolved hydrocarbons in a separator maintained at a temperature which is at least 80% of the temperature of the second formation and at a pressure which is at least 80% of the pressure of the second formation;

(d) injecting hot water from the separator containing dissolved hydrocarbons into the first formation via the first injection means to heat and displace viscous petroleum contained therein toward the first production means; and (e) recovering heated viscous from the first formation via the first production means.

* * * * *